US005979415A

United States Patent [19]

Sparks et al.

[11] Patent Number: 5,979,415

[45] Date of Patent: Nov. 9, 1999

[54] FUEL INJECTION PUMP WITH A HYDRAULICALLY-SPILL VALVE

[75] Inventors: James D. Sparks, Edelstein; Dennis M. Ruttle, Washington, both of Ill.

[73] Assignee: Caterpillar Inc., Peoria, Ill.

[21] Appl. No.: 08/968,367

[22] Filed: Nov. 12, 1997

[51] Int. Cl.[6] ..... F02M 37/04

[52] U.S. Cl. ..... 123/506; 123/446

[58] Field of Search ..... 123/446, 506, 123/458, 447, 500, 501, 467

[56] References Cited

U.S. PATENT DOCUMENTS

| | | | |
|---|---|---|---|
| 3,122,100 | 2/1964 | Bessiere | 103/41 |
| 4,211,202 | 7/1980 | Hafner | 123/467 |
| 4,412,519 | 11/1983 | Hoch | 123/500 |
| 4,475,514 | 10/1984 | List | 123/458 |
| 4,546,749 | 10/1985 | Igashira | 123/458 |
| 4,590,908 | 5/1986 | Yoshinaga | 123/500 |
| 4,840,155 | 6/1989 | Karle | 123/506 |
| 5,033,443 | 7/1991 | Kato | 123/506 |
| 5,036,821 | 8/1991 | Horiuchi et al. | 123/506 |
| 5,373,828 | 12/1994 | Askew | 123/506 |
| 5,478,213 | 12/1995 | Harris | 123/506 |
| 5,575,253 | 11/1996 | Lambert et al. | 123/300 |
| 5,628,293 | 5/1997 | Gibson et al. | 123/446 |

FOREIGN PATENT DOCUMENTS

93/19292 9/1993 WIPO ..... F02M 57/02

OTHER PUBLICATIONS

Patents Abstracts of Japan, vol. 008, No. 220 (M–330) , Oct. 6, 1984 & JP 59 103960 A (Nissan Jidosha KK) , Jun. 15, 1984.

*Primary Examiner*—Carl S. Miller
*Attorney, Agent, or Firm*—Michael B. McNeil

[57] ABSTRACT

A fuel injection pump, preferably for use with relatively large diesel engines employing heavy diesel fuel, includes a pump body that defines a portion of a fuel pressurization chamber in fluid communication with a fuel outlet and a spill passage. The pump body also defines a pressure control chamber and an actuation fluid passage. A spill valve member, which has a pressure surface is exposed to fluid pressure in the pressure control chamber and is moveable between an inject position that blocks the spill passage and a spill position that opens the spill passage. An electronically controlled valve has a control valve member that is moveable between a first position in which the actuation fluid passage is open to the pressure control chamber, and a second position in which the actuation fluid passage is blocked to the pressure control chamber.

20 Claims, 4 Drawing Sheets

FUEL INJECTION PUMP WITH A HYDRAULICALLY-SPILL VALVE

TECHNICAL FIELD

The present invention relates generally to fuel injection pumps, and more particularly to a heavy diesel fuel injection pump having an electronically-controlled hydraulically-actuated spill valve.

BACKGROUND ART

In one class of electronically controlled fuel injectors, a cam is utilized to drive a plunger within the injector body, and an electronically controlled spill valve is utilized to control timing of the injection event. Each injection event is initiated by closing the spill valve so that fuel pressure can build above a valve opening pressure that lifts the needle check valve and opens the nozzle outlet of the fuel injector. In many of these type of fuel injectors, the spill valve includes a solenoid attached to a spill valve member. Typically, low pressure fuel is allowed to circulate around the armature of the solenoid in order to avoid the need for internal sealing, which can be difficult to impossible to reliably accomplish.

While this spill valve technology has worked well in relatively small diesel engines that utilize distillate diesel fuel, relatively large diesel engines have been unable to adopt this technology since they burn heavy diesel fuel. Heavy diesel fuel has viscosity somewhere on the order of road tar at regular temperatures and must normally be heated to a temperature sometimes in excess of 400° Fahrenheit in order to make the same sufficiently flowable through a fuel injection pump. Because of the extremely high viscosity of heavy diesel fuel, the current state of the art in relatively large diesel engines continues to be cam actuated fuel injection pumps that have no electronic timing control. The reason that the known spill technology cannot be incorporated into heavy diesel fuel injection systems is because the spill valve simply cannot be made to reliably perform when surrounded by relatively high viscosity heavy diesel fuel. Therefore, some other means must be devised for overcoming the problems of incorporating electronic control into heavy diesel fuel injection systems for relatively large diesel engines.

The present invention is directed to overcoming these and other problems, as well as generally improving electronically controlled fuel injection systems.

DISCLOSURE OF THE INVENTION

A fuel injection pump includes a pump body defining a portion of a fuel pressurization chamber in fluid communication with a fuel outlet and a spill passage. The pump body also defines a pressure control chamber and an actuation fluid passage. A spill valve member having a pressure surface exposed to fluid pressure in the pressure control chamber is moveable between an inject position that blocks the spill passage and a spill position that opens the spill passage. An electronically controlled valve has a control valve member that is moveable between a first position in which the actuation fluid passage is open to the pressure control chamber, and a second position in which the actuation fluid passage is blocked to the pressure control chamber.

In another embodiment, the pump body defines a portion of a fuel pressurization chamber that is in fluid communication with a fuel inlet, a fuel outlet and a spill passage. The pump body also defines an actuation fluid inlet, a pressure control chamber and an actuation fluid passage. A spill valve member has a pressure surface exposed to fluid pressure in the pressure control chamber and is moveable between an inject position that blocks the spill passage and a spill position that opens the spill passage. An electronically controlled valve has a control valve member that is moveable between a first position in which the actuation fluid passage is opened to the pressure control chamber, and a second position in which the actuation fluid passage is blocked to the pressure control chamber. The fuel inlet is connected to a source of heavy diesel fuel. The actuation fluid inlet is connected to a source of actuation fluid that is different from heavy diesel fuel.

In still another embodiment, a heavy diesel fuel injection pump includes a pump body that defines a heavy diesel fuel inlet, a heavy diesel fuel outlet, a tappet opening, a connection passage, a spill passage and a plunger bore. A tappet is positioned in the tappet opening and is moveable between a retracted position and an advanced position. A plunger is positioned in the plunger bore and is attached to move with the tappet between the retracted position and the advanced position. A portion of the plunger and the plunger bore define a fuel pressurization chamber connected to the heavy diesel fuel outlet by the connection passage. The spill passage is separated from the connection passage by a valve seat. An electronically controlled valve is attached to the pump body and has a spill valve member and a solenoid. The solenoid includes moveable components isolated from contact with heavy diesel fuel passing through the pump body. The spill valve member is moveable between an inject position in which the spill valve member is seated against the valve seat, and a spill position in which the spill valve member is away from the valve seat.

BEST MODE FOR CARRYING OUT THE INVENTION

Figure 1:
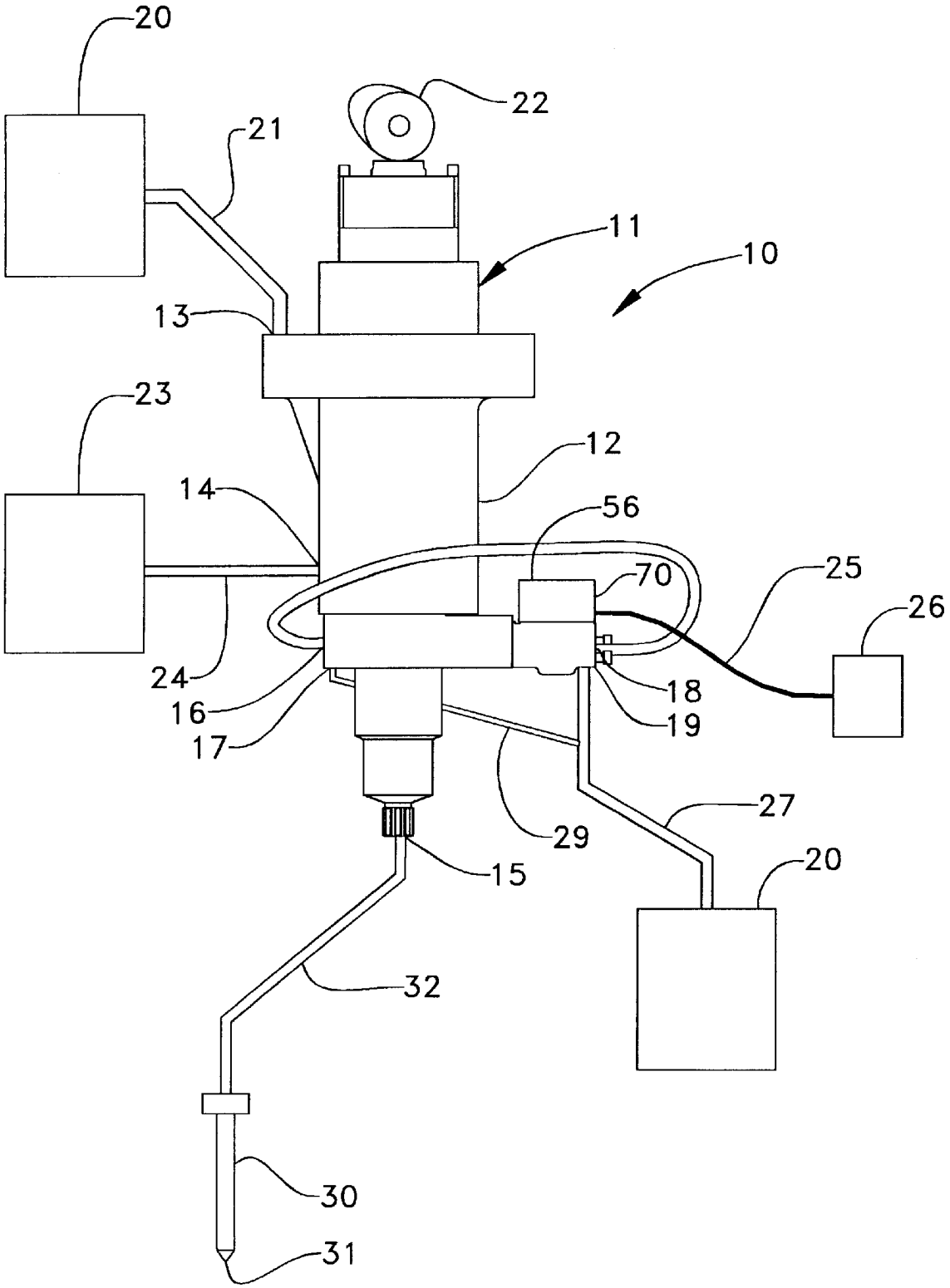
FIG. 1 is a schematic illustration of a fuel injection system according to the present invention.

Referring now to FIG. 1, a fuel injection system 10 includes a fuel injection pump 11 having a pump body 12. The pump body defines an actuation fluid inlet 13, a fuel inlet 14, a fuel outlet 15, a high pressure actuation fluid outlet 16, an actuation fluid pressure relief outlet 17, a high pressure actuation fluid inlet 18, and an actuation fluid drain outlet 19. Actuation fluid inlet 13 is connected to the relatively low pressure source of actuation fluid 20 via an actuation fluid supply line 21. Source 20 could hold any suitable relatively low viscosity fluid such as distillate fuel, but preferably contains engine lubricating oil. In the preferred embodiment, source 20 is simply a lubricating oil sump for the engine to which fuel injection system 10 is attached.

Fuel inlet 14 is connected to a source of fuel fluid 23 via a fuel supply line 24. In the preferred embodiment, fuel injection system 10 is for use with heavy diesel fuel, and therefore source 23 preferably contains heavy diesel fuel. Nevertheless, the present invention could find use in relatively smaller diesel engines that utilize distillate diesel fuel.

Fuel injection pump 11 is actuated by a conventional cam 22 that is driven to rotate by the engine (not shown). While cam 22 is used to actuate fuel injection pump 11, the timing of each injection event is controlled via an electronic control module 26 that is attached to electronically controlled valve 70 via communication line 25. Although the preferred embodiment is a cam driven pump, hydraulically-actuated fuel injectors could also benefit from the present invention.

During each injection event, actuation fluid flows from high pressure outlet 16 and into high pressure inlet 18 via external actuation fluid passage 56. A portion of the actuation fluid escapes out of pressure relief outlet 17, into pressure relief drain passage 29 and eventually into drain passage 27. Between injection events, actuation fluid leaves electronically control valve 70 via drain outlet 19 into drain passage 27. Drain passage 27 is connected to the source of actuation fluid 20, which as stated earlier is preferably an engine lubricating oil fluid sump.

Between each injection event, an amount of fuel is drawn into fuel inlet 14. During each injection event, that fuel is pressurized within pump body 12 and leaves fuel outlet 15. The high pressure fuel then travels along nozzle supply line 32 to nozzle 30 and eventually out of nozzle outlet 31, which may be opened and closed by a conventional needle check valve of a type known in the art.

Figure 2:
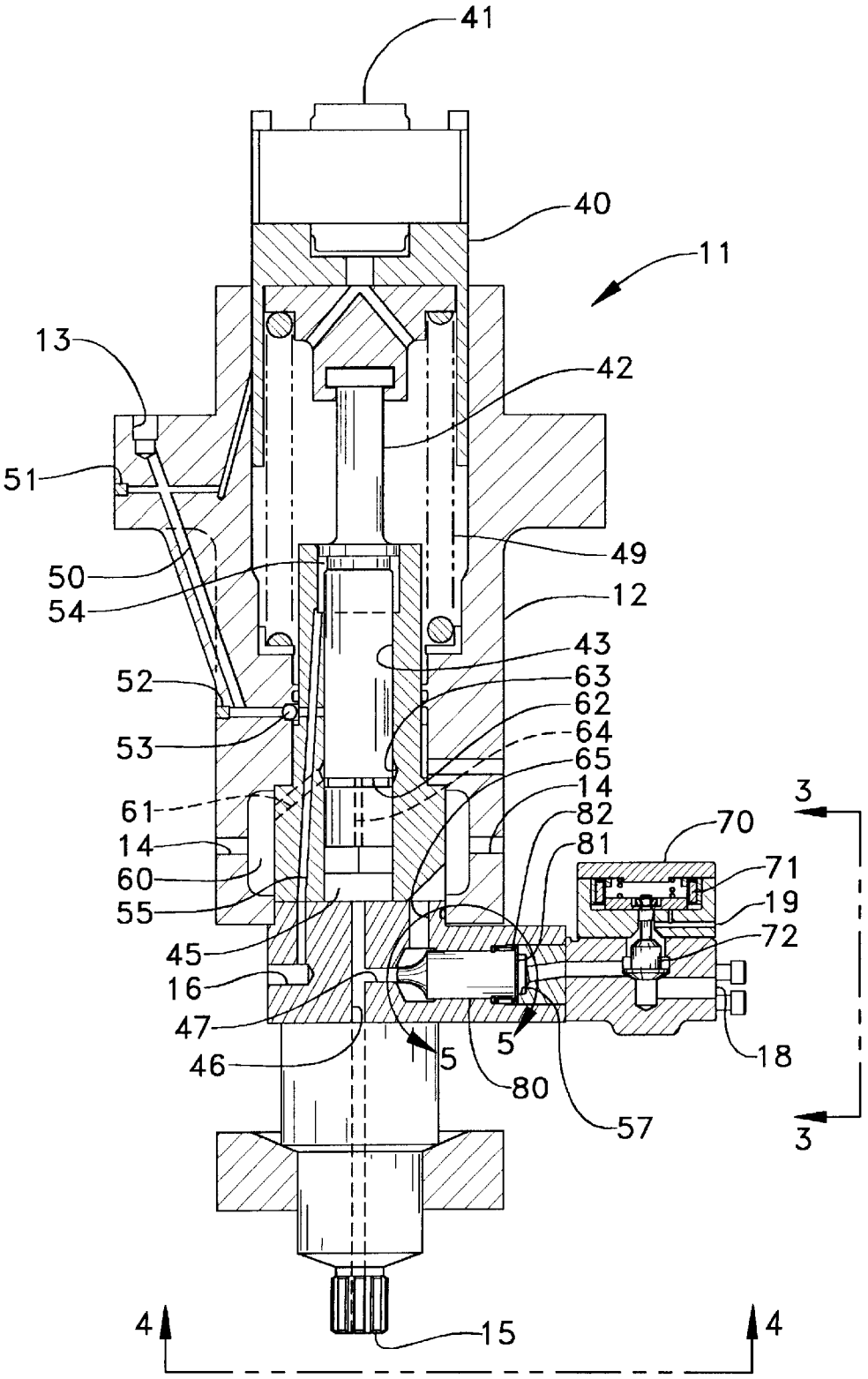
FIG. 2 is a sectioned front elevational view of a fuel injection pump according to one embodiment of the present invention.

Referring now to FIG. 2, the internal structure of fuel injection pump 11 is illustrated. The pump includes a tappet assembly 40 having an external cam contact surface 41 and an internal plunger 42, both of which are driven to move by a cam between a retracted position, as shown, and an advanced position. Plunger 42 moves in a plunger bore 43 that is defined by pump body 12. A portion of plunger 42 and plunger bore 43 define a fuel pressurization chamber 45 that is in fluid communication with fuel outlet 15 via a connection passage 46. A spill passage 47 opens on one end into connection passage 46 and on its other end to a spill connection passage 65 past a conical valve seat 85 (see FIG. 5).

Fuel inlet 14 opens into a fuel gallery 60 defined within pump body 12. When plunger 42 is in its retracted position, fuel pressurization chamber 45 is connected to fuel gallery 60 via a slanted fuel connection passage 61, a plunger bore annulus 63, a plunger annulus 62 and a vertical passage 64. Fuel pressurization chamber 45 is also connected to fuel gallery 60 via spill connection passage 65, spill passage 47 and a portion of connection passage 46.

In addition to fuel pressurization chamber 45, a portion of plunger 42 and plunger bore 43 define an actuation fluid pump chamber 54. Actuation fluid pump chamber 54 is in fluid communication with actuation fluid inlet 13 via an actuation fluid supply passage 50 and a portion of internal actuation fluid passage 55. A pair of low pressure plugs 51 and 52 permit the various passageways to be machined from outside of injector body 12. A check valve 53 permits actuation fluid to flow into actuation fluid pump chamber 54 when plunger 42 is retracting, but prevents the back flow of actuation fluid into supply passage 50 when the plunger 42 is undergoing its downward stroke.

Figure 3:
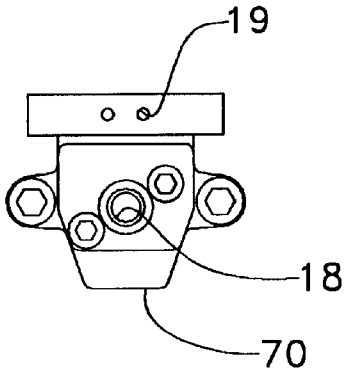
FIG. 3 is a side view of an electronically controlled valve according to one aspect of the present invention and as viewed along lines 3—3 of FIG. 2.
Figure 4:
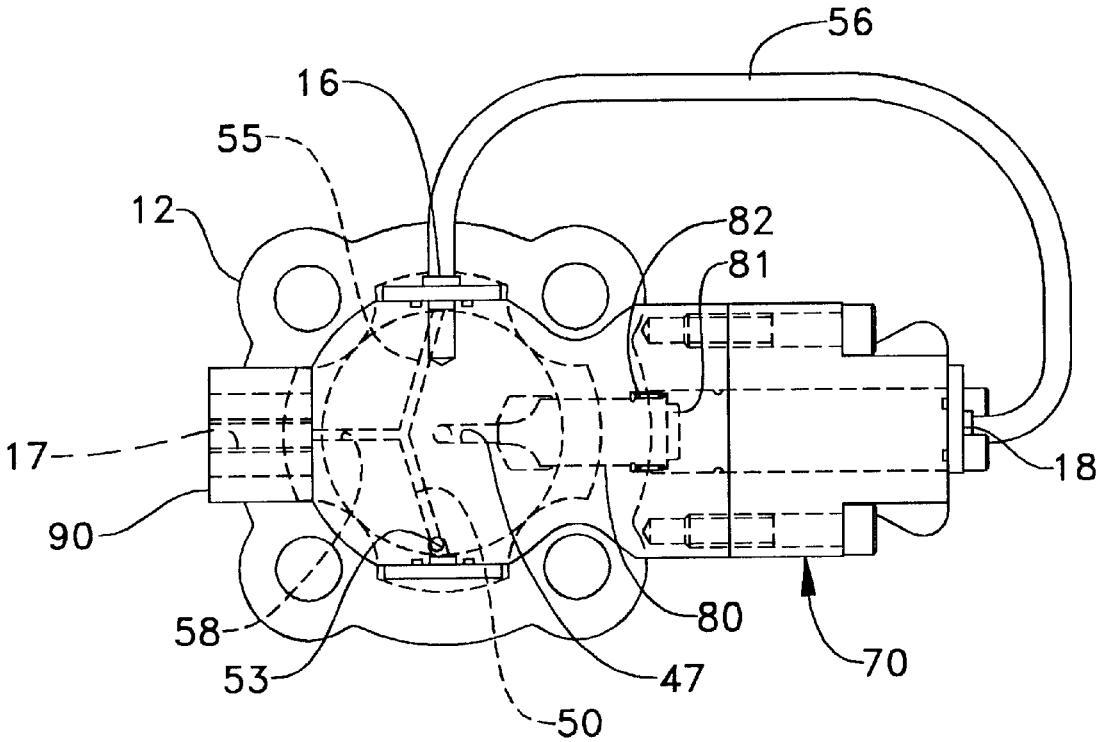
FIG. 4 is a bottom view of the fuel injection pump of FIG. 2.
Figure 5:
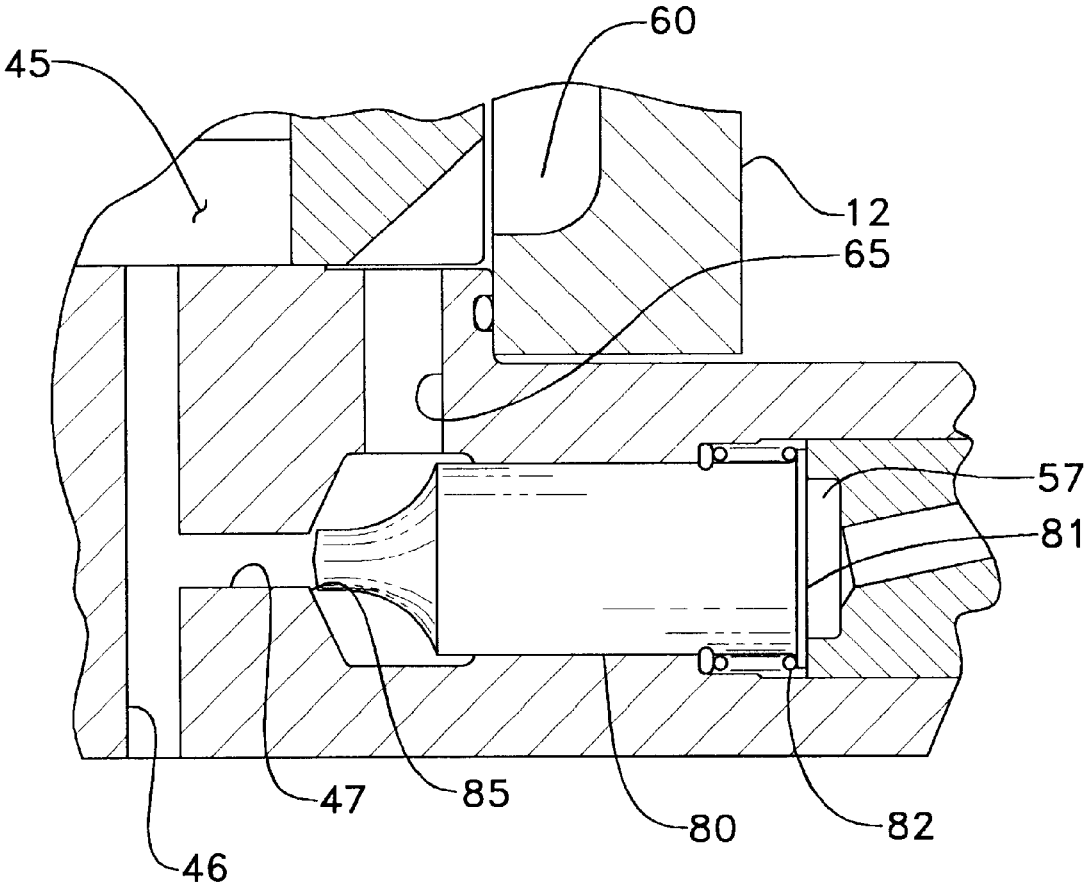
FIG. 5 is an enlarged view of the spill valve member area 5—5 of FIG. 2.
Figure 6:
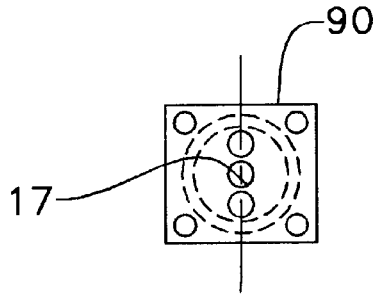
FIG. 6 is a side view of a pressure relief device according to one aspect of the present invention as viewed along lines 6—6 of FIG. 4.

Referring now in addition to FIGS. 3–5, actuation fluid pump chamber 54 is connected to a pressure control chamber 57 via internal actuation fluid passage 55 and external actuation fluid passage 56. Pump chamber 54 is also connected to a pressure relief device 90 via an internal pressure relief passage 58 (FIG. 4). Pressure relief device 90 is utilized to insure that the actuation fluid pressure arriving at high pressure inlet 18 does not exceed a pre-determined magnitude.

The high pressure actuation fluid arriving at inlet 18 passes through electronically controlled valve 70 before reaching pressure control chamber 57. Electronically controlled valve 70 includes a solenoid 71 that is attached to a control valve member 72. Control valve member 72 is moveable by solenoid 71 between a first position in which pressure control chamber 57 is open to high pressure inlet 18 and a second position in which inlet 18 is blocked to pressure control chamber 57. At the same time, control valve member 72 preferably opens and closes pressure control chamber 57 to drain outlet 19.

A spill valve member 80 is positioned in pump body 12 and is moveable between an inject position in which a portion of the spill valve member is seated against conical valve seat 85 to block spill passage 47. The other end of spill valve member 80 is a pressure surface 81 that is exposed to fluid pressure within pressure control chamber 57. When pressure in control chamber 57 is relatively low, a biasing spring 82 moves spill valve member to a spill position that opens spill passage 47 to spill connection passage 65. However, when fluid pressure in control chamber 57 is high, the pressure force acting on surface 81 pushes spill valve member to the left against conical valve seat 85 to its inject position that closes spill passage 47.

INDUSTRIAL APPLICABILITY

Each injection event begins when cam 22 begins to drive tappet assembly 40 downward. When this occurs, actuation fluid pressure begins to build in pump chamber 54 since control valve member 72 is biased toward a position that closes high pressure inlet 18. Also, as plunger 42 begins its downward stroke, plunger annulus 62 moves out of fluid communication with plunger bore annulus 63. As plunger 42 continues its downward stroke, actuation fluid pressure reaches a pre-determined magnitude and any excess pressure is relieved through pressure relief device 90. At the same time, fuel within fuel pressurization chamber 45 continues to be at a relatively low pressure since the fuel is spilling into spill passage 47. Spill valve member 80 is biased to its spill position by biasing spring 82, and the pressure control chamber 57 is open to the relatively low pressure of drain 19 at this time.

When it is desired to commence the injection event, the electronic control module 26 commands electronically controlled valve 70 to move control valve member 72 to a position that closes low pressure drain 19 and opens high pressure inlet 18. This movement of control valve member 72 suddenly exposes pressure control chamber 57 to the high pressure in pump chamber 54. This high fluid pressure pushes spill valve member 80 leftward to its inject position against conical valve seat 85 to close spill passage 47. When this occurs, fuel pressure within fuel pressurization chamber 45 quickly rises. Preferably, the area of the spill valve member exposed to fuel pressure is sized relative to pressure surface 81 such that the valve opens slightly to allow fuel leakage if fuel pressure exceeds a rated maximum for the particular pump. This aspect of the invention prevents the fuel from becoming over-pressurized. As plunger 42 continues its downward stroke, the fuel in fuel pressurization chamber 45 and nozzle 30 eventually exceeds a valve opening pressure that opens nozzle outlet 31 causing fuel to squirt into the combustion chamber of the engine.

Each injection event is ended by de-energizing solenoid 71 so that control valve member 72 moves to a position that closes high pressure inlet 18 and reopens drain outlet 19. This creates a sudden pressure drop in pressure control chamber 57 allowing control valve member 80 to move away from valve seat 85 to open spill passage 47 under the action of biasing spring 82. When spill passage 47 opens, the fuel in fuel pressurization chamber 45 and nozzle 30 quickly drops below a pressure sufficient to hold nozzle outlet 31 open. The nozzle outlet then closes and the fuel injection event is over.

Between injection events, tappet assembly 40 retracts under the action of tappet biasing spring 49. As plunger 42 retracts, fuel is drawn into fuel pressurization chamber 45 from fuel gallery 60, along spill connection passage 65, into spill passage 47 and up a portion of connection passage 46. At the same time, actuation fluid is drawn into pump chamber 54 from actuation fluid inlet 13 and past check valve 53. When tappet assembly 40 is fully retracted, fuel injection pump 11 is ready for its next injection event.

By making the spill valve hydraulically-actuated rather than electronically-actuated, as in the prior art, the moveable components (armature, etc.) of the solenoid can be isolated from any contact with the heavy diesel fuel. Furthermore, because the pressure in spill connection passage 65 is always relatively low, fuel fluid tends not to migrate along the outside surface of spill valve member 80 into pressure control chamber 57. This ensures that spill valve member 80 remains adequately lubricated and free from seizure produced by buildup of solid precipitates caused by contact between heavy diesel fuel and lubricating oil. Plunger 42 also maintains adequate lubrication since any fuel migrating up the outside surface of plunger 42 from fuel pressurization chamber 45 escapes back into fuel gallery 60 via plunger bore annulus 63 and slanted connection passage 61. At the same time, a slight amount of lubricating oil migrates down the outside edge of plunger 42 from pump chamber 54 in order to maintain proper lubrication.

Those skilled in the art will appreciate that the previous description is intended for illustrative purposes only and is not intended to limit the scope of the present invention in any way. For instance, while the present invention finds preferred application in the case of fuel injection systems utilizing relatively viscous heavy diesel fuel, the present invention could find potential application in a fuel injection system using virtually any type of fuel. Thus, those skilled in the art will appreciate that numerous variations and modifications can be made to the illustrated embodiments without departing from the spirit and scope of the invention, which is defined in terms of the claims set forth below.

We claim:

1. A heavy diesel fuel injection pump comprising:

a pump body defining a heavy diesel fuel inlet, a heavy diesel fuel outlet, a tappet opening, a connection passage, a spill passage and a plunger bore;

a tappet positioned in said tappet opening and moveable between a retracted position and an advanced position;

a plunger positioned in said plunger bore and being attached to move with said tappet between said retracted position and said advanced position;

a portion of said plunger and said plunger bore defining a fuel pressurization chamber connected to said heavy diesel fuel outlet by said connection passage;

said spill passage being separated from said connection passage by a valve seat;

an electronically controlled valve attached to said pump body and having a spill valve member and a solenoid;

said solenoid including moveable components isolated from contact with heavy diesel fuel passing through said pump body; and said spill valve member being moveable between an inject position in which said spill valve member is seated against said valve seat, and a spill position in which said spill valve member is away from said valve seat.

2. The heavy diesel fuel injection pump of claim 1 wherein said pump body defines a pressure control chamber; and said spill valve member including a pressure surface exposed to fluid pressure in said pressure control chamber.

3. The heavy diesel fuel injection pump of claim 2 wherein said pump body defines an actuation fluid passage and an actuation fluid drain; and said electronically controlled valve includes a control valve member attached to said solenoid, and being moveable between a first position in which said actuation fluid passage is open to said pressure control chamber, and a second position in which said pressure control chamber is open to said actuation fluid drain.

4. The heavy diesel fuel injection pump of claim 3 wherein said plunger and said pump body define an actuation fluid pump chamber; and said actuation fluid pump chamber being connected to said actuation fluid passage.

5. The heavy diesel fuel injection pump of claim 4 wherein said actuation fluid pump chamber is connected to a source of actuation fluid;

said fuel pressurization chamber is connected to a source of heavy diesel fuel.

6. The heavy diesel fuel injection pump of claim 5 wherein said source of actuation fluid contains engine lubricating oil.

7. The heavy diesel fuel injection pump of claim 15 further comprising a pressure relief device in fluid communication with said actuation fluid pump chamber.

8. The heavy diesel fuel injection pump of claim 7 wherein said spill passage is in fluid communication with said heavy diesel fuel inlet; and said plunger defines a portion of a fuel passage that connects said fuel pressurization chamber to said heavy diesel fuel inlet when said plunger is in said retracted position.

9. The heavy diesel fuel injection pump of claim 19 further comprising a return spring operably positioned to bias said spill valve member toward said spill position.

10. A fuel injection pump comprising:

a pump body defining a portion of a fuel pressurization chamber in fluid communication with a fuel outlet and a spill passage, and further defining a pressure control chamber and an actuation fluid passage, and said fuel pressurization chamber being fluidly isolated from said pressure control chamber;

a spill valve member having a pressure surface exposed fluid pressure in said pressure control chamber and being movable between an inject position that blocks said spill passage and a spill position that opens said spill passage; and an electronically controlled valve with a control valve member movable between a first position in which said actuation fluid passage is open to said pressure control chamber, and a second position in which said actuation fluid passage is blocked to said pressure control chamber.

11. The fuel injection pump of claim 10 further comprising a tappet assembly including a contact surface located outside said pump body and a plunger end located in said fuel pressurization chamber, and said tappet assembly being movable with respect to said pump body between an advanced position and a retracted position.

12. The fuel injection pump of claim 10 wherein said pump body defines a portion of an actuation fluid pump chamber; and said actuation fluid pump chamber being connected to said actuation fluid passage.

13. The fuel injection pump of claim 10 further comprising a pressure relief device in fluid communication with said actuation fluid passage.

14. The fuel injection pump of claim 10 wherein said electronically controlled valve includes a solenoid attached to said control valve member.

15. The fuel injection pump of claim 10 wherein said pump body defines a fuel inlet connected to a source of heavy diesel fuel and an actuation fluid inlet connected to a source of actuation fluid that is different from heavy diesel fuel.

16. A fuel injection pump comprising:

a pump body defining a portion of a fuel pressurization chamber in fluid communication with a fuel inlet, a fuel outlet and a spill passage, and further defining an actuation fluid inlet, a pressure control chamber and an actuation fluid passage;

a spill valve member having a pressure surface exposed fluid pressure in said pressure control chamber and being movable between an inject position that blocks said spill passage and a spill position that opens said spill passage;

an electronically controlled valve with a control valve member movable between a first position in which said actuation fluid passage is open to said pressure control chamber, and a second position in which said actuation fluid passage is blocked to said pressure control chamber;

said fuel inlet being connected to a source of heavy diesel fuel; and said actuation fluid inlet being connected to a source of actuation fluid that is different from heavy diesel fuel.

17. The fuel injection pump of claim 16 wherein said electronically controlled valve includes a solenoid that is isolated from contact with said heavy diesel fuel.

18. The fuel injection pump of claim 17 further comprising a tappet assembly including a contact surface located outside said pump body and a plunger end located in said fuel pressurization chamber, and said tappet assembly being movable with respect to said pump body between an advanced position and a retracted position.

19. The fuel injection pump of claim 18 wherein said pump body and said tappet assembly define an actuation fluid pump chamber positioned between said actuation fluid inlet and said actuation fluid passage; and said actuation fluid pump chamber being connected to said actuation fluid passage.

20. The fuel injection pump of claim 19 further comprising a pressure relief device in fluid communication with said actuation fluid passage.

* * * * *